US009576586B2

(12) United States Patent
Kishi et al.

(10) Patent No.: US 9,576,586 B2
(45) Date of Patent: Feb. 21, 2017

(54) AUDIO CODING DEVICE, AUDIO CODING METHOD, AND AUDIO CODEC DEVICE

(71) Applicant: FUJITSU LIMITED, Kawasaki-shi, Kanagawa (JP)

(72) Inventors: Yohei Kishi, Kawasaki (JP); Akira Kamano, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 14/717,517

(22) Filed: May 20, 2015

(65) Prior Publication Data

US 2015/0371640 A1 Dec. 24, 2015

(30) Foreign Application Priority Data

Jun. 23, 2014 (JP) ..... 2014-128487

(51) Int. Cl.

| | |
|---|---|
| ***G10L 19/00*** | (2013.01) |
| ***G10L 21/00*** | (2013.01) |
| ***G10L 19/032*** | (2013.01) |
| *G10L 19/02* | (2013.01) |

(52) U.S. Cl.

CPC ..... *G10L 19/032* (2013.01); *G10L 19/0204* (2013.01)

(58) Field of Classification Search

USPC ..... 704/500

See application file for complete search history.

(56) References Cited

U.S. PATENT DOCUMENTS

| | | | | |
|---|---|---|---|---|
| 4,231,103 | A * | 10/1980 | Timm | G06F 17/141 708/404 |
| 6,339,757 | B1 * | 1/2002 | Teh | H04B 1/665 704/219 |
| 2005/0278171 | A1 * | 12/2005 | Suppappola | G10L 19/012 704/227 |
| 2007/0168186 | A1 | 7/2007 | Ide | |
| 2011/0119061 | A1 * | 5/2011 | Brown | G10L 19/008 704/258 |
| 2012/0290305 | A1 * | 11/2012 | Feng | G10L 19/002 704/500 |

FOREIGN PATENT DOCUMENTS

| | | |
|---|---|---|
| JP | 2000-267686 | 9/2000 |
| JP | 2007-193043 | 8/2007 |
| JP | 2013-195713 | 9/2013 |

* cited by examiner

*Primary Examiner* — Marivelisse Santiago Cordero
*Assistant Examiner* — Kevin Ky
(74) *Attorney, Agent, or Firm* — Staas & Halsey LLP

(57) ABSTRACT

An audio coding device includes a memory; and a processor configured to execute a plurality of instructions stored in the memory, the instructions comprising: selecting a main lobe among a plurality of lobes detected from a frequency signal configuring an audio signal on a basis of bandwidth and power of the lobes; and coding the audio signal in such a manner that a first amount of bits per a unit frequency domain allocated to coding of the frequency signal of the main lobe is larger than a second amount of bits per the unit frequency domain allocated to the coding of the frequency signal of a side lobe as a lobe other than the main lobe.

13 Claims, 11 Drawing Sheets

FIG. 8

| ADTS HEADER | ch-1 DATA | ch-2 DATA | ... | ch-N DATA |
|---|---|---|---|---|

FIG. 9

| | OBJECTIVE SOUND QUALITY EVALUATION VALUE |
|---|---|
| COMPARATIVE EXAMPLE | -2.63 |
| EMBODIMENT EXAMPLE 1 | -2.23 |

AUDIO CODING DEVICE, AUDIO CODING METHOD, AND AUDIO CODEC DEVICE

CROSS-REFERENCE TO RELATED APPLICATION

This application is based upon and claims the benefit of priority from the prior Japanese Patent Application No. 2014-128487 filed on Jun. 23, 2014, the entire contents of which are incorporated herein by reference.

FIELD

The embodiments discussed herein are related to an audio coding device, an audio coding method, an audio coding program, an audio codec device, and an audio coding and decoding method for example.

BACKGROUND

As related arts, audio coding techniques for compressing audio signals (sound source of voice, music, etc.) are being developed. For example, as the audio coding techniques, the Advanced Audio Coding (AAC) system, the High Efficiency-Advanced Audio Coding (HE-AAC) system, and so forth exist. The AAC system and the HE-AAC system are one of Moving Picture Experts Group (MPEG)-2/4 Audio standards of ISO/IEC and are widely used for broadcast purposes such as digital broadcasting for example.

In the broadcast purpose, audio signals are transmitted under restrictions of a limited transmission bandwidth. Therefore, in the case of coding audio signals at a low bit rate, the band in which the coding is carried out is selected because it is difficult to code the audio signals in the whole frequency band. In general, in the AAC system, a bit rate equal to or lower than about 64 kbps can be regarded as a low bit rate and a bit rate equal to or higher than about 128 kbps can be regarded as a high bit rate. For example, Japanese Laid-open Patent Publication No. 2007-193043 discloses a technique in which coding is carried out with dropping of audio signals with power lower than given power so that the amount of bits for the coding may fall within a given bit rate.

SUMMARY

In accordance with an aspect of the embodiments, an audio coding device includes a memory; and a processor configured to execute a plurality of instructions stored in the memory, the instructions comprising: selecting a main lobe among a plurality of lobes detected from a frequency signal configuring an audio signal on a basis of bandwidth and power of the lobes; and coding the audio signal in such a manner that a first amount of bits per a unit frequency domain allocated to coding of the frequency signal of the main lobe is larger than a second amount of bits per the unit frequency domain allocated to the coding of the frequency signal of a side lobe as a lobe other than the main lobe.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIG. 8 is a diagram depicting one example of a data format in which multiplexed audio signals are stored;

FIG. 9 represents objective evaluation values of embodiment example 1 and a comparative example;

DESCRIPTION OF EMBODIMENTS

Embodiment examples of an audio coding device, an audio coding method, an audio coding computer program, and an audio codec device, and an audio coding and decoding method according to one embodiment will be described below on the basis of the drawings. These embodiment examples shall not limit techniques of the disclosure.

Embodiment Example 1

Figure 1:
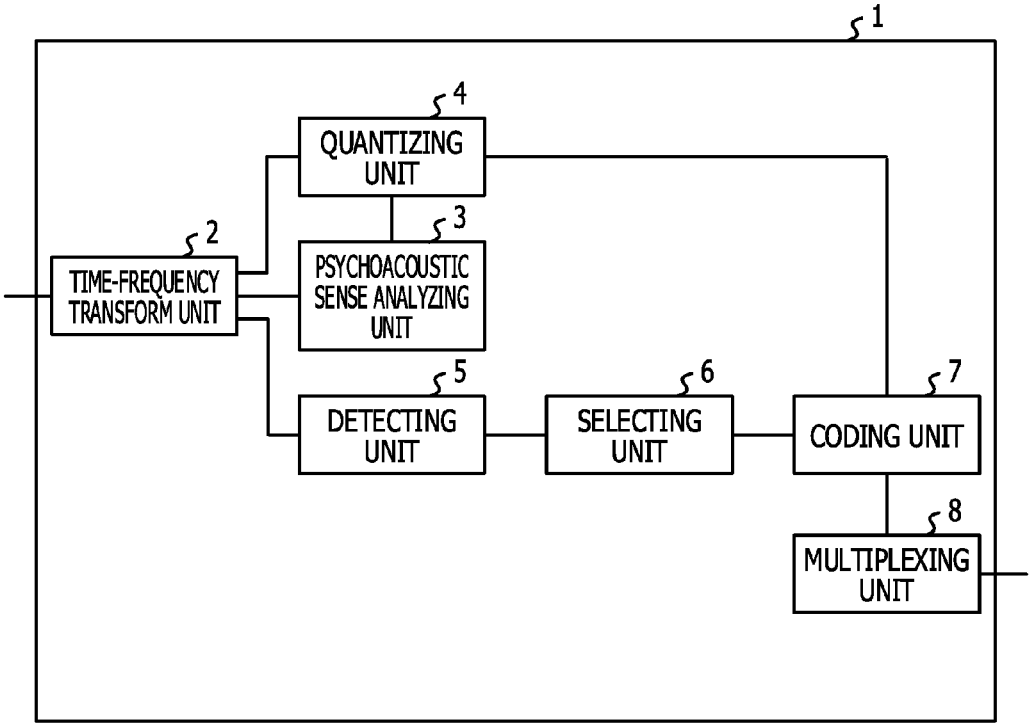
FIG. 1 is a functional block diagram of an audio coding device according to one embodiment.
Figure 2:
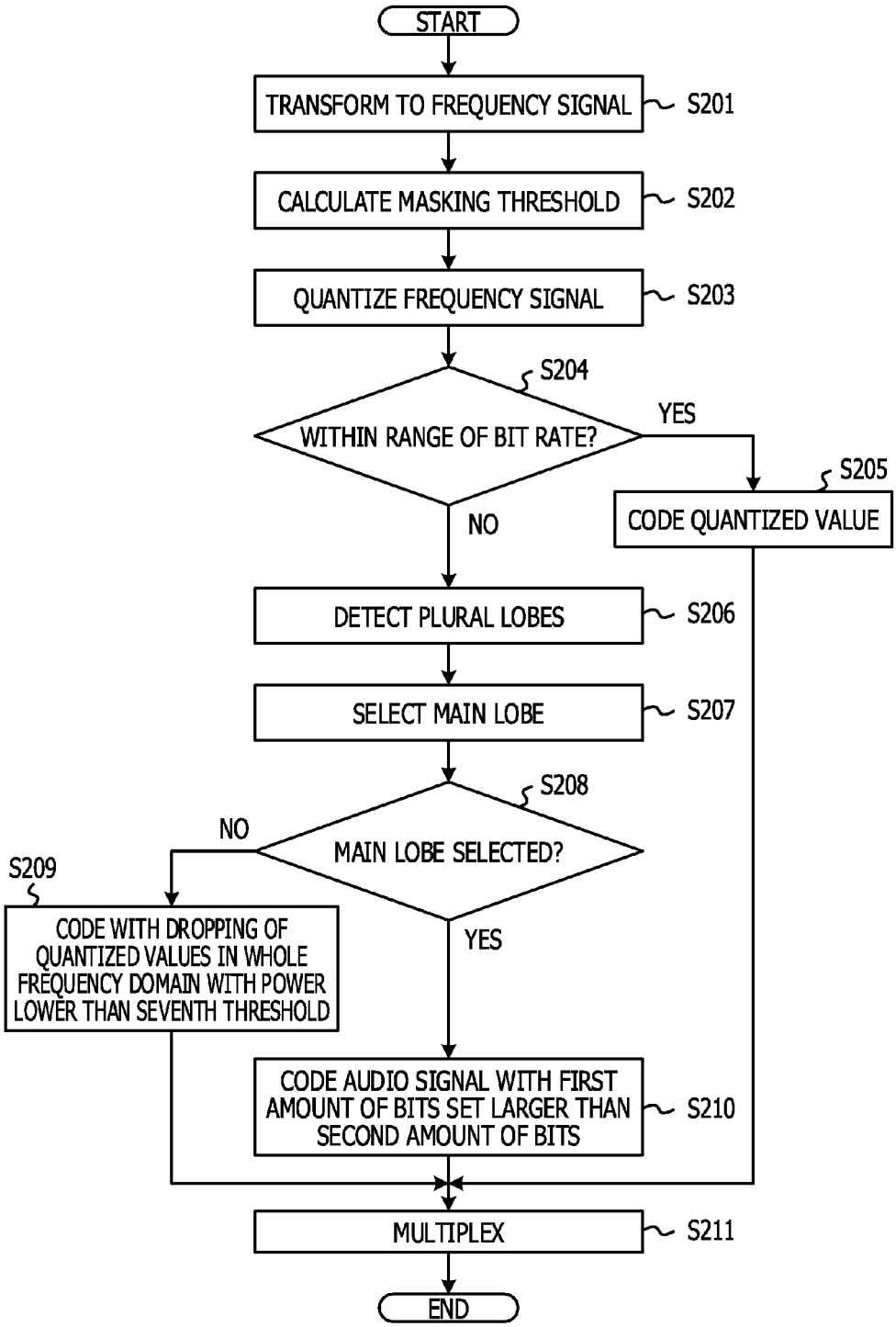
FIG. 2 is a flowchart of coding processing of an audio coding device.

FIG. 1 is a functional block diagram of an audio coding device according to one embodiment. FIG. 2 is a flowchart of coding processing of an audio coding device. In embodiment example 1, a flow of the coding processing by the audio coding device depicted in FIG. 2 will be explained in association with explanation of each function in the functional block diagram of the audio coding device depicted in FIG. 1. As depicted in FIG. 1, an audio coding device 1 has a time-frequency transform unit 2, a psychoacoustic sense analyzing unit 3, a quantizing unit 4, a detecting unit 5, a selecting unit 6, a coding unit 7, and a multiplexing unit 8.

The above-described respective units possessed by the audio coding device 1 are formed as hardware circuits configured by hard-wired logic as separate circuits from each other for example. Alternatively, the above-described respective units possessed by the audio coding device 1 may be implemented in the audio coding device 1 as one integrated circuit obtained by integration of circuits corresponding to the respective units. The integrated circuit may be an integrated circuit such as an Application Specific Integrated Circuit (ASIC) or a Field Programmable Gate Array (FPGA) for example. Moreover, the above-described respective units possessed by the audio coding device 1 may be functional modules implemented by a computer program executed on a computer processor possessed by the audio coding device 1.

The time-frequency transform unit 2 is a hardware circuit configured by hard-wired logic for example. Furthermore, the time-frequency transform unit 2 may be a functional module implemented by a computer program executed in the audio coding device 1. The time-frequency transform unit 2 transforms signals of the respective channels in the time domain in an audio signal input to the audio coding device 1 (e.g. multichannel audio signal of Nch (N=2, 3, 3.1, 5.1, or 7.1)) to frequency signals of the respective channels by performing a time-frequency transform on each of the signals in units of frame. This processing corresponds to a step S201 in the flowchart depicted in FIG. 2. In embodiment example 1, the time-frequency transform unit 2 transforms the signal of each channel to the frequency signal by using a fast Fourier transform for example. In this case, the transform expression to transform a time-domain signal Xch(t) of a channel ch in a frame t to a frequency signal is expressed as the following expression for example.

$$spec_{ch}(t)_i = \sum_{k=0}^{S-1} X_{ch}(t)_k \exp\left(-j\frac{2\pi \cdot i \cdot k}{S}\right),\ i = 0, \ldots, S-1 \quad \text{(Expression 1)}$$

In the above-described (Expression 1), k is a variable representing the time and represents the k-th time when the audio signal of one frame is equally divided into S sections in the time direction. The frame length can be prescribed to any of 10 to 80 msec for example. i is a variable representing the frequency and represents the i-th frequency when the whole of the frequency band is equally divided into S sections. S is set to 1024 for example. $spec_{ch}(t)_i$ is the i-th frequency signal of the channel ch in the frame t. The time-frequency transform unit 2 may transform each of the time-domain signals of the respective channels to the frequency signal by using another arbitrary time-frequency transform processing such as a discrete cosine transform (DCT), a modified discrete cosine transform (MDCT), or a Quadrature Mirror Filter (QMF) filter bank. Every time calculating the frequency signal of each channel in units of frame, the time-frequency transform unit 2 outputs the frequency signal of each channel to the psychoacoustic sense analyzing unit 3, the quantizing unit 4, and the detecting unit 5.

The psychoacoustic sense analyzing unit 3 is a hardware circuit configured by hard-wired logic for example. Furthermore, the psychoacoustic sense analyzing unit 3 may be a functional module implemented by a computer program executed in the audio coding device 1. The psychoacoustic sense analyzing unit 3 divides the frequency signal of each channel into plural bands including a predefined bandwidth on each frame basis and calculates the spectral power and the masking threshold of each of the bands. This processing corresponds to a step S202 in the flowchart depicted in FIG. 2. The psychoacoustic sense analyzing unit 3 can calculate the spectral power and the masking threshold by using a method described in C.1 Psychoacoustic Model in Annex C of ISO/IEC 13818-7 for example. ISO/IEC 13818-7 is one of international standards jointly developed by International Organization for Standardization (ISO) and International Electrotechnical Commission (IEC).

The psychoacoustic sense analyzing unit 3 calculates the spectral power of each band in accordance with the following expression for example.

$$specPow_{ch}[b](t) = \sum_{i}^{bw[b]} spec_{ch}(t)_i^2 \quad \text{(Expression 2)}$$

In the above-described (Expression 2), $specPow_{Ch}[b](t)$ is power indicating the spectral power of a frequency band b of the channel ch in the frame t and bw[b] represents the bandwidth of the frequency band b.

The psychoacoustic sense analyzing unit 3 calculates the masking threshold representing power as the lower limit of the frequency signal of the sound audible by a listener (listener may be referred to as a user) for each frequency band. Furthermore, the psychoacoustic sense analyzing unit 3 may output a value set in advance for each frequency band as the masking threshold for example. Alternatively, the psychoacoustic sense analyzing unit 3 may calculate the masking threshold according to the auditory characteristics of the listener. In this case, the masking threshold about the frequency band given a focus in the frame of the coding target is higher when the spectral power of the same frequency band in a frame previous to the frame of the coding target and the spectral power of the adjacent frequency band in the frame of the coding target are higher. The psychoacoustic sense analyzing unit 3 can calculate the masking threshold in accordance with calculation processing of a threshold (equivalent to the masking threshold) described in an item of C.1. 4 Steps in Threshold Calculation in C.1 Psychoacoustic Model in Annex C of ISO/IEC 13818-7 for example. In this case, the psychoacoustic sense analyzing unit 3 calculates the masking threshold by using the frequency signals of the immediately preceding frame and the next preceding frame of the frame of the coding target. For this purpose, the psychoacoustic sense analyzing unit 3 may include a memory or a cache (not depicted) in order to store the frequency signals of the immediately preceding frame and the next preceding frame of the frame of the coding target. The psychoacoustic sense analyzing unit 3 outputs the masking threshold of each channel to the quantizing unit 4.

The quantizing unit 4 is a hardware circuit configured by hard-wired logic for example. Furthermore, the quantizing unit 4 may be a functional module implemented by a computer program executed in the audio coding device 1. The quantizing unit 4 receives the masking threshold of each channel from the psychoacoustic sense analyzing unit 3 and receives the frequency signal of each channel from the time-frequency transform unit 2. The quantizing unit 4 carries out quantization through scaling of the frequency signal $spec_{ch}(t)_i$ of each channel with a scale value based on the masking threshold of each channel. This processing corresponds to a step S203 in the flowchart depicted in FIG. 2. The quantizing unit 4 can carry out quantization by using a method described in an item of C.7 Quantization in Annex C of ISO/IEC 13818-7 for example. The quantizing unit 4 can carry out quantization on the basis of the following expression for example.

$$quant_{ch}(t)_i = \text{sign}(spec_{ch}(t)_i) \cdot \text{int}(|spec_{ch}(t)_i|^{0.75} \cdot 2^{-0.1875 \cdot scale_{ch}[b](t)} + 0.4054) \quad \text{(Expression 3)}$$

In the above-described (Expression 3), $quant_{ch}(t)_i$ is a quantized value of the i-th frequency signal of the channel ch in the frame t, and $scale_{ch}[b](t)$ is a quantization scale calculated about the frequency band in which the i-th frequency signal is included. The quantizing unit 4 outputs the quantized value obtained by quantizing the frequency signal of each channel to the coding unit 7.

The detecting unit 5 is a hardware circuit configured by hard-wired logic for example. Furthermore, the detecting unit 5 may be a functional module implemented by a computer program executed in the audio coding device 1. The detecting unit 5 receives the frequency signal of each channel from the time-frequency transform unit 2. The detecting unit 5 detects plural lobes composed of the frequency signal of each channel configuring the audio signal. This processing corresponds to a step S206 in the flowchart depicted in FIG. 2. For example, the detecting unit 5 can calculate plural inflection points (the plural inflection points may be referred to as the inflection point group) of the power of the frequency signal by an arbitrary method (e.g. second order differential) and detect, as one lobe, an interval from a downward-convex inflection point A to a downward-convex inflection point B adjacent to the inflection point A (furthermore, the length of this interval may be referred to as the width of the lobe. Moreover, this width may be referred to as the bandwidth or the frequency bandwidth). As the width of the lobe, the half width at half maximum about the lobe may be used.

Figure 3:
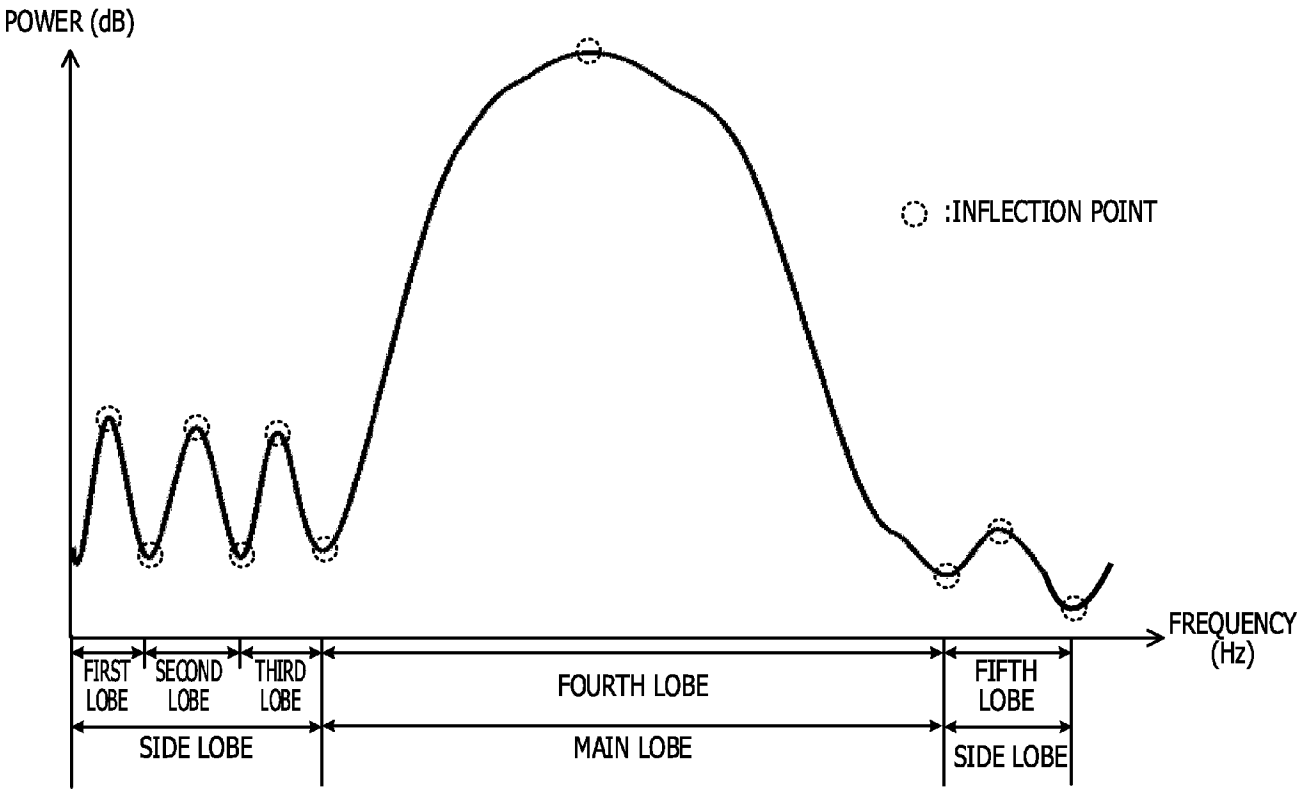
FIG. 3 is a spectral diagram of a fricative consonant.
Figure 4:
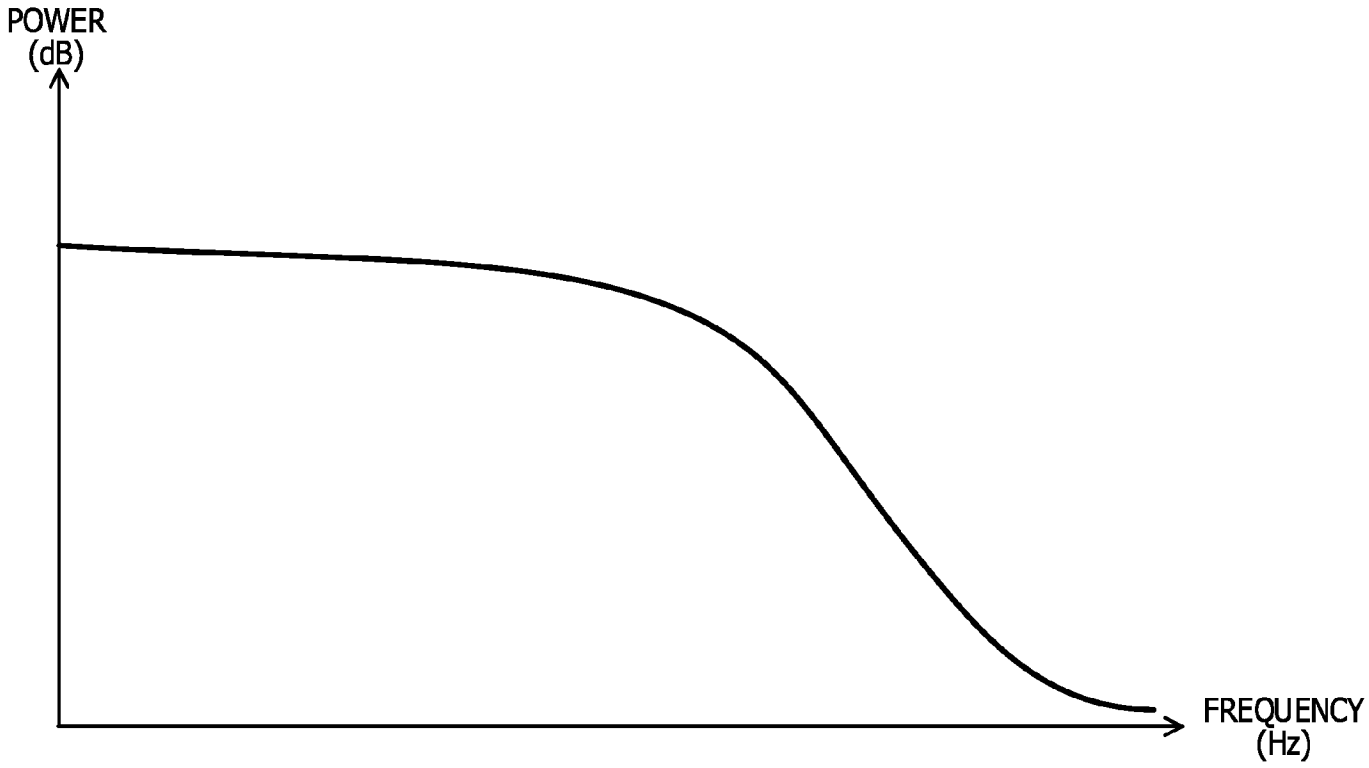
FIG. 4 is a spectral diagram of a consonant other than fricatives.
Figure 5:
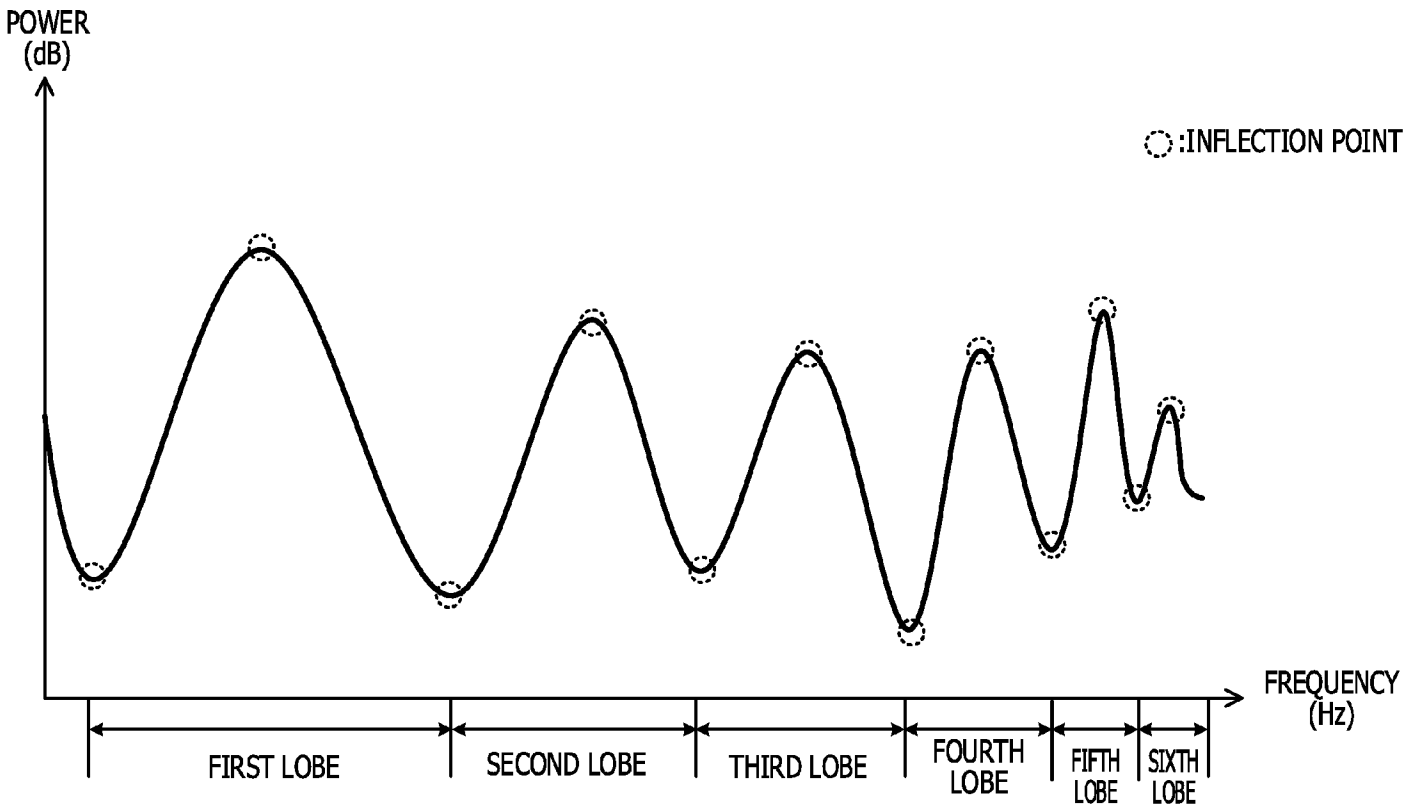
FIG. 5 is a spectral diagram of a vowel.

FIG. 3 is a spectral diagram of a fricative consonant. FIG. 4 is a spectral diagram of a consonant other than fricatives. FIG. 5 is a spectral diagram of a vowel. As depicted in FIGS. 3 and 5, by the detecting unit 5, plural inflection points (the plural inflection points may be referred to as the inflection point group) are detected and intervals between downward-convex inflection points adjacent to each other are detected as lobes. In the spectrum of the consonant other than the fricatives in FIG. 4, an inflection point does not exist and thus a lobe is not detected. The detecting unit 5 outputs the detected plural lobes of each channel to the selecting unit 6.

The selecting unit 6 in FIG. 1 is a hardware circuit configured by hard-wired logic for example. Furthermore, the selecting unit 6 may be a functional module implemented by a computer program executed in the audio coding device 1. The selecting unit 6 receives plural lobes in each channel from the detecting unit 5. The selecting unit 6 selects a main lobe on the basis of the widths of the plural lobes and the power of the lobes. This processing corresponds to a step S207 in the flowchart depicted in FIG. 2. For example, the selecting unit 6 selects the lobe having the largest width among the plural lobes as a main lobe candidate. Then, the selecting unit 6 selects the main lobe candidate as the main lobe if the width (frequency bandwidth) of the main lobe candidate is equal to or larger than a given first threshold (Th1) (e.g. first threshold=10 kHz) and the power of the main lobe candidate is equal to or larger than a given second threshold (Th2) (e.g. second threshold=20 dB). The selecting unit 6 can use, as the power, the absolute value of the difference between the maximum value and the minimum value of the power of each lobe for example. Furthermore, the selecting unit 6 may use, as the power, the ratio between the maximum value and the minimum value of the power of the lobe. The main lobe may be referred to as the first lobe.

For example, in the spectrum of the fricative consonant depicted in FIG. 3, a fourth lobe is the lobe having the largest width and therefore the selecting unit 6 selects the fourth lobe as the main lobe candidate. The selecting unit 6 determines whether or not the width of the fourth lobe as the main lobe candidate is equal to or larger than the first threshold. For convenience of explanation, suppose that the width of the fourth lobe as the main lobe candidate is equal to or larger than the first threshold in embodiment example 1. If the condition that the width of the fourth lobe as the main lobe candidate is equal to or larger than the first threshold is satisfied, then the selecting unit 6 determines whether or not the power of the fourth lobe as the main lobe candidate is equal to or larger than the second threshold. For convenience of explanation, suppose that the power of the fourth lobe as the main lobe candidate is equal to or larger than the second threshold in embodiment example 1. In this manner, the selecting unit 6 can select, as the main lobe, the fourth lobe as the main lobe candidate. In other words, the main lobe is the lobe that has the largest width among the plural lobes detected by the detecting unit 5 and satisfies the condition that the width is equal to or larger than the first threshold and has power equal to or larger than the second threshold. The lobes other than the main lobe (the first lobe to the third lobe and the fifth lobe) may be referred to as the side lobes. Furthermore, the side lobe may be referred to as the second lobe.

In the spectrum of the vowel depicted in FIG. 5, a first lobe is the widest lobe and thus the first lobe is selected as the main lobe candidate. The selecting unit 6 determines whether or not the width of the first lobe as the main lobe candidate is equal to or larger than the first threshold. For convenience of explanation, suppose that the width of the first lobe as the main lobe candidate is smaller than the first threshold in embodiment example 1. Because the width of the first lobe as the main lobe candidate is smaller than the first threshold, the first lobe as the main lobe candidate is not selected as the main lobe. In other words, as the first threshold and the second threshold, thresholds satisfying conditions under which only the main lobe of the fricative consonant depicted in FIG. 3 can be selected may be experimentally prescribed.

Figure 6:
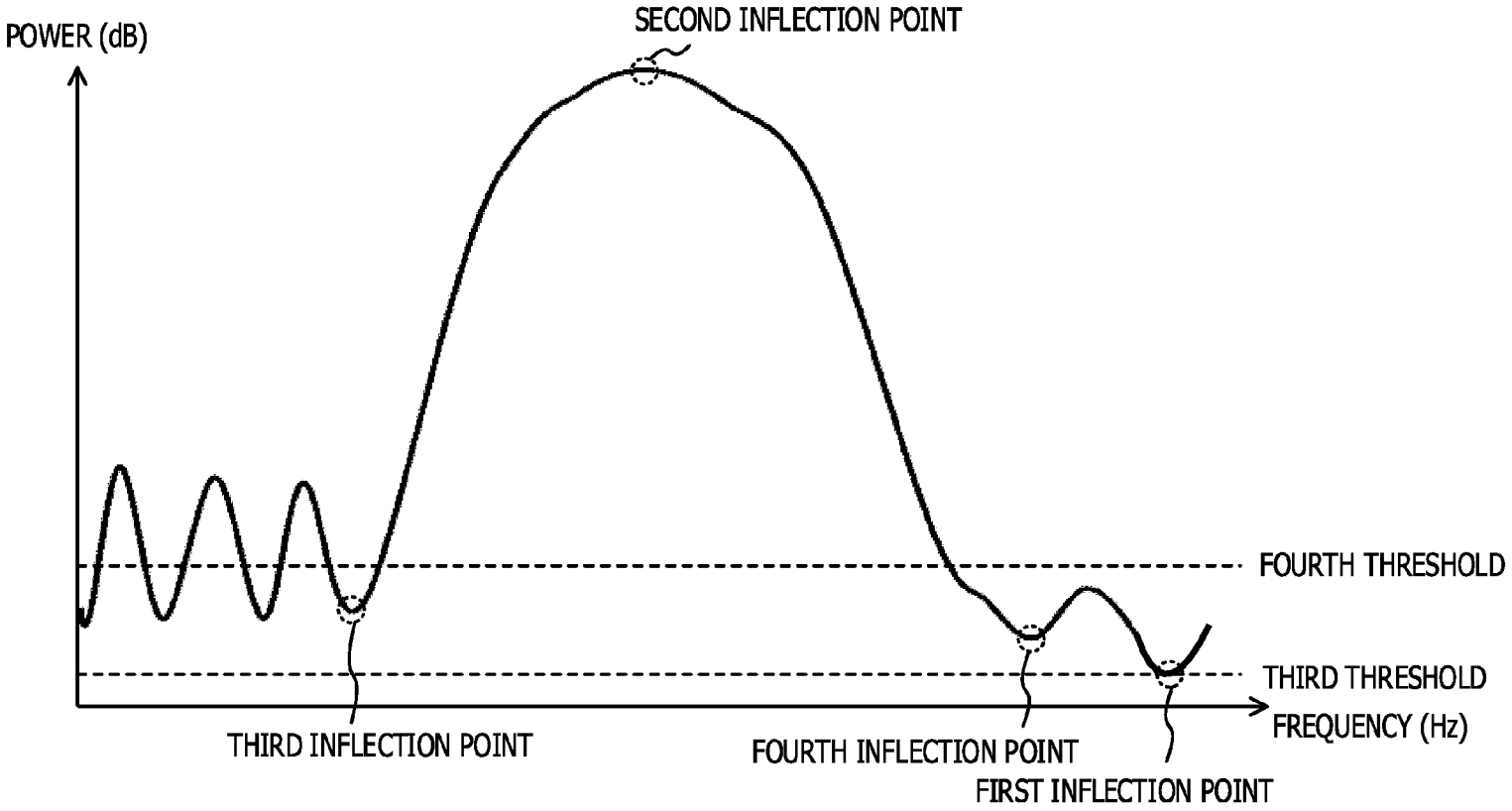
FIG. 6 is a conceptual diagram of selection of a band of a main lobe.

In the inflection point group, the selecting unit 6 may prescribe the value of a first inflection point at which the power of the lobe is the lowest as a third threshold (Th3) and prescribe a value obtained by increase in the power by a given value (e.g. 3 dB) from the third threshold as a fourth threshold (Th4). Moreover, in this inflection point group, the selecting unit 6 may select a third inflection point and a fourth inflection point as the start point and the end point of the main lobe. The third inflection point and the fourth inflection point are adjacent to a second inflection point at which the power of the main lobe is the highest on the lower frequency side and the higher frequency side, respectively. Besides, each of the third inflection point and the fourth inflection point has a value that is equal to or larger than the third threshold and is smaller than the fourth threshold. FIG. 6 is a conceptual diagram of selection of a band of a main lobe. FIG. 6 depicts the spectrum of a fricative consonant as with FIG. 3. As depicted in FIG. 6, the third threshold and the fourth threshold and the first inflection point to the fourth inflection point are prescribed and the start point and the end point of the main lobe are prescribed. The interval between these start point and end point can be treated as the band (width) of the lobe. Even when spike noise or frequency signal is superimposed on the main lobe, the selecting unit 6 can reduce the influence of this spike noise or frequency signal to select the main lobe by using the method disclosed in FIG. 6. The selecting unit 6 outputs the main lobe selected on each channel basis to the coding unit 7. If it is impossible to select the main lobe, the selecting unit 6 is allowed to execute selection processing of the next frame or another channel.

The coding unit 7 in FIG. 1 is a hardware circuit configured by hard-wired logic for example. Furthermore, the coding unit 7 may be a functional module implemented by a computer program executed in the audio coding device 1. The coding unit 7 receives the quantized value of the audio signal of each channel from the quantizing unit 4 and receives the main lobe of the audio signal of each channel from the selecting unit 6. The coding unit 7 codes the quantized value of the frequency signal of each channel received from the quantizing unit 4 by using an entropy code such as a Huffman code or an arithmetic code. Next, the coding unit 7 calculates the total amount $totalBit_{ch}(t)$ of bits of the entropy code on each channel basis. Next, the coding unit 7 determines whether or not the total amount $totalBit_{ch}(t)$ of bits of the entropy code is smaller than the amount $pBit_{ch}(t)$ of allocated bits based on a bit rate prescribed in advance (e.g. 64 kbps). This processing corresponds to a step S204 in the flowchart depicted in FIG. 2. If the total amount $totalBit_{ch}(t)$ of bits of the entropy code is smaller than the amount $pBit_{ch}(t)$ of allocated bits based on the bit rate prescribed in advance (corresponding to the step S204—Yes in FIG. 2), the coding unit 7 outputs the entropy code as a coded audio signal to the multiplexing unit 8. This processing corresponds to a step S205 in the flowchart depicted in FIG. 2. Furthermore, in the case of the step S204—Yes in FIG. 2, the coding unit 7 may instruct the detecting unit 5 to stop the detection processing of plural lobes for example. This can reduce the processing cost of the coding of the audio coding device 1. Furthermore, the coding unit 7 may make the detecting unit 5 execute the detection processing of plural lobes in the case of the step S204—No in FIG. 2.

The coding unit 7 determines whether or not the main lobe is received from the selecting unit 6 in an arbitrary frame of an arbitrary channel. In other words, the coding unit 7 checks whether or not the selecting unit 6 has selected the main lobe by using the above-described first threshold and second threshold. This processing corresponds to a step S208 in the flowchart depicted in FIG. 2. If the total amount $totalBit_{ch}(t)$ of bits of the entropy code is equal to or larger than the amount $pBit_{ch}(t)$ of allocated bits and the main lobe is selected (corresponding to the step S208—Yes in FIG. 2), the coding unit 7 codes the audio signal in such a manner that a first amount of bits per unit frequency domain (e.g. 5 kHz) allocated to the coding of the frequency signal of the main lobe is larger than a second amount of bits per unit frequency domain allocated to the coding of the frequency signal of the side lobe as the lobe other than the main lobe. This processing corresponds to a step S210 in the flowchart depicted in FIG. 2. For example, the coding unit 7 performs the coding in such a manner as to drop the frequency signal of the side lobe so that the first amount of bits and the second amount of bits for the coding of the audio signal may converge on a given bit rate.

If the total amount $totalBit_{ch}(t)$ of bits of the entropy code is equal to or larger than the amount $pBit_{ch}(t)$ of allocated bits and the main lobe is not selected (corresponding to the step S208—No in FIG. 2), the coding unit 7 may perform the coding with dropping of the quantized values in the whole frequency domain with power lower than an arbitrary seventh threshold. This processing corresponds to a step S209 in the flowchart depicted in FIG. 2.

Figure 7A:
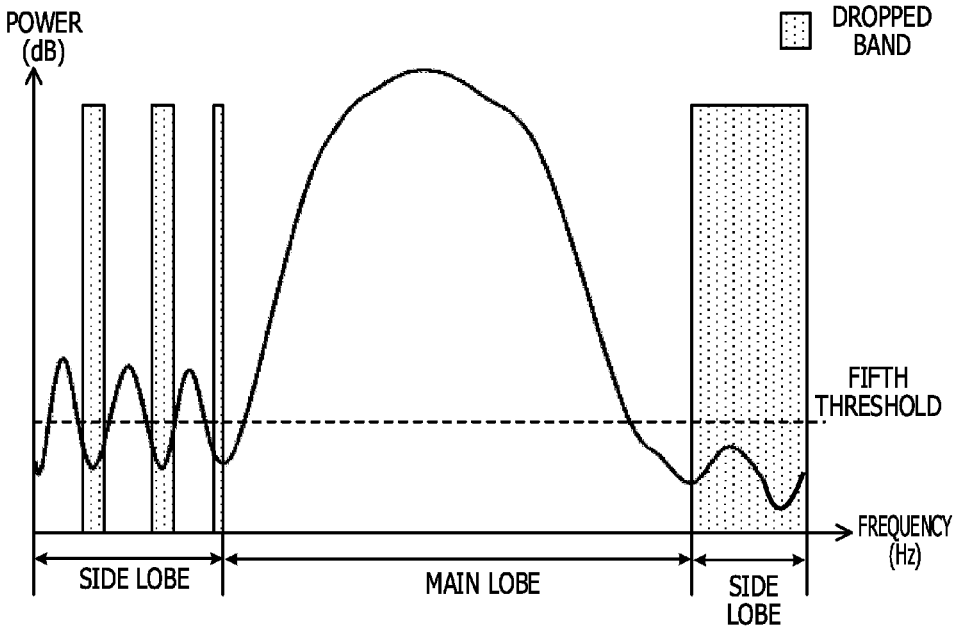
FIG. 7A is a first conceptual diagram of coding processing by a coding unit.
Figure 7B:
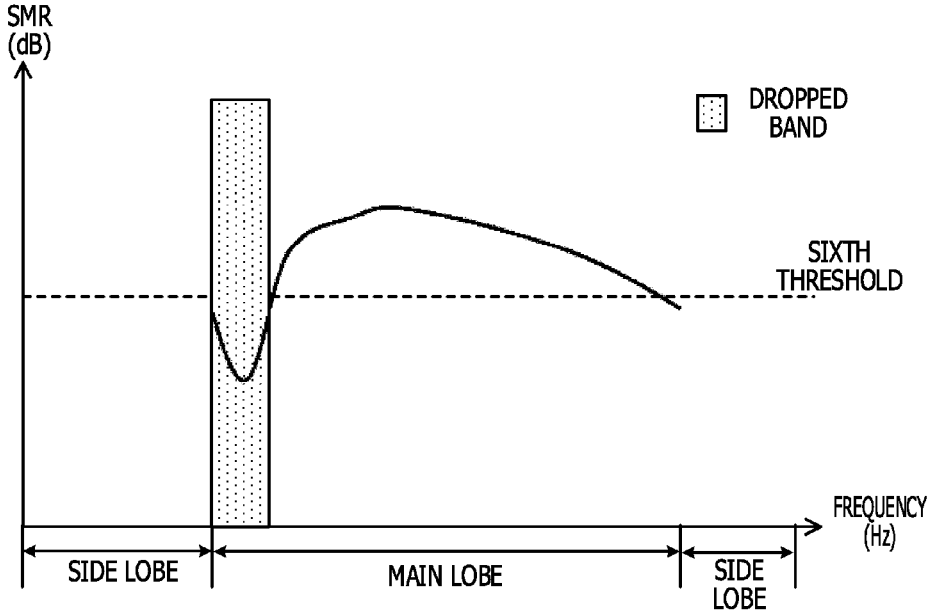
FIG. 7B is a second conceptual diagram of coding processing by a coding unit.

FIG. 7A is a first conceptual diagram of coding processing by a coding unit. FIG. 7B is a second conceptual diagram of coding processing by a coding unit. The coding unit described with reference to FIGS. 7A and 7B may be the coding unit 7 depicted in FIG. 1. It is to be noted that FIG. 7A corresponds to the spectrum of a fricative consonant. As depicted in FIG. 7A, the coding unit 7 codes the audio signal in such a manner as to drop the frequency signal of the side lobe in increasing order of the power of the frequency signal until convergence on the bit rate (in other words, until the total amount $totalBit_{ch}(t)$ of bits of the entropy code becomes smaller than the amount $pBit_{ch}(t)$ of allocated bits). For example, the coding unit 7 performs the coding with dropping of the quantized values that correspond to the side lobe and have power smaller than a fifth threshold (Th5) that is to satisfy the given bit rate and serves as a variable threshold for the side lobe. In the case of performing coding with use of the fifth threshold, the coding unit 7 can perform the coding with increase in the fifth threshold if the given bit rate is not satisfied. In other words, the coding unit 7 can code all quantized values in the frequency band of the main lobe in exchange for dropping all quantized values in the frequency band of the side lobe according to need.

Here, technical significance in embodiment example 1 will be described. The present inventors made a examination in detail about cause of the lowering of the sound quality of the audio signal in coding at a low bit rate and have revealed the following respects as a result of the intense examination. For example, a fricative consonant like that represented in the spectrum of FIG. 3 is a turbulent airflow generated when expired air passes through a point constricted in an oral cavity (e.g. a point constricted by teeth, in the case of the column of "sa" in the Japanese syllabary), and includes high power and a wide lobe (corresponding to the main lobe in embodiment example 1) on the high frequency side of the frequency band. The band used to acoustically perceive the fricative consonant is the whole of the band of the main lobe including the ends of the main lobe, and it has turned out that subjective and objective deterioration of the sound quality is acoustically perceived at the time of decoding if a signal in this band is lost by dropping. Meanwhile, it has also turned out that a consonant other than the fricatives like that represented in the spectrum of FIG. 4 is comparatively-less affected by dropping at the time of decoding because including a wide frequency band uniformly. Moreover, it has also turned out that a vowel like that represented in the spectrum of FIG. 5 is comparatively-less affected by dropping at the time of decoding because the vowel has plural similar lobes and mutual correlations among the lobes form the vowel. In other words, in embodiment example 1, suppression of the deterioration of the sound quality is enabled by the following process. The selecting unit 6 determines whether or not a fricative consonant is included in an audio signal through the selection processing of the main lobe for example. If a fricative consonant is included, coding is performed with priority to the main lobe over the side lobe until the amount of bits relating to the coding falls within the bit rate.

Audio coding of the normal AAC system or the like is compatible with coding for various kinds of sound sources including e.g. a noise sound source other than sound sources including lobes (voice, instrument sound, etc.). In the audio coding of the AAC system or the like, determination processing and so forth to collectively drop predefined plural bands are executed in order to perform coding with high efficiency even with various kinds of sound sources. As an additional remark, these plural bands do not correspond with the width of the lobe normally and therefore, with the general audio coding, it is impossible to conceive the idea of performing coding with differentiation between the main lobe and the side lobe.

Moreover, if the given bit rate is not satisfied even after dropping of all quantized values in the frequency band of the side lobe, the coding unit 7 may code the audio signal on the basis of the ratio of the power of the frequency signal in the main lobe to the masking threshold (Signal to Masking threshold Ratio (SMR)) according to need. FIG. 7B depicts the SMR corresponding to the spectrum of FIG. 7A. The masking threshold represents the power under which the sound is unheard due to the masking effect in terms of the auditory sense and the SMR represents how much the power of the frequency signal is higher than the masking threshold. When the SMR is higher, the corresponding band is acoustically more important. Therefore, by dropping the frequency band in increasing order of the SMR in coding processing as depicted in FIG. 7B, the coding unit 7 can perform coding for the band that is acoustically more important. For example, the coding unit 7 drops the band in which the SMR is lower than a sixth threshold (Th6) as a variable threshold and performs the coding with increase in the sixth threshold until the amount of bits falls within the given bit rate. The coding unit 7 outputs the audio signal of each channel resulting from the coding (this audio signal may be referred to as the coded audio signal) to the multiplexing unit 8.

The multiplexing unit 8 in FIG. 1 is a hardware circuit configured by hard-wired logic for example. Furthermore, the multiplexing unit 8 may be a functional module implemented by a computer program executed in the audio coding device 1. The multiplexing unit 8 receives the coded audio signals from the coding unit 7. The multiplexing unit 8 multiplexes the coded audio signals by arranging the coded audio signals in given order. This processing corresponds to a step S211 in the flowchart depicted in FIG. 2. FIG. 8 is a diagram depicting one example of a data format in which multiplexed audio signals are stored. In one example depicted in FIG. 8, the coded audio signals are multiplexed in accordance with an MPEG-4 Audio Data Transport Stream (ADTS) format. As depicted in FIG. 8, data of the entropy code of each channel (ch-1 data, ch-2 data, ch-N data) are stored. Furthermore, header information of the ADTS format (ADTS header) is stored ahead of the blocks of the data of the entropy code. The multiplexing unit 8 outputs the multiplexed coded audio signals to an arbitrary external device (e.g. audio decoding device). The multiplexed coded audio signals may be output to an external device via a network.

The present inventors conducted a verification experiment that quantitatively indicated effects of embodiment example 1. FIG. 9 represents objective evaluation values of embodiment example 1 and a comparative example. In this verification experiment, the bit rate was set to 64 kbps and utterance voice of a woman was used as the sound source. As the comparative example, quantized values of frequencies of power equal to or lower than a certain threshold were dropped across the board irrespective of the main lobe and the side lobe. As the decoding method, a general decoding method was used under the same condition in both embodiment example 1 and the comparative example. As the evaluation method, an objective sound quality evaluation value called Objective Difference Grade (ODG) was used. The ODG is expressed by a value in a range of "0" to "−5" and a larger value (value closer to zero) indicates higher sound quality. In general, when a difference of 0.1 or larger exists in the ODG, a difference in the sound quality can be perceived also subjectively. As depicted in FIG. 9, in embodiment example 1, an improvement in the objective sound quality evaluation value by about 0.4 compared with the comparative example was confirmed. In the subjective evaluation, it was confirmed that, in the comparative example, a degraded sound like "gyuru-gyuru" was superimposed on fricative consonant parts due to superposition of an error attributed to the dropping.

In the audio coding device depicted in embodiment example 1, it is possible to perform coding with high sound quality even under a coding condition with a low bit rate.

Embodiment Example 2

Figure 10:
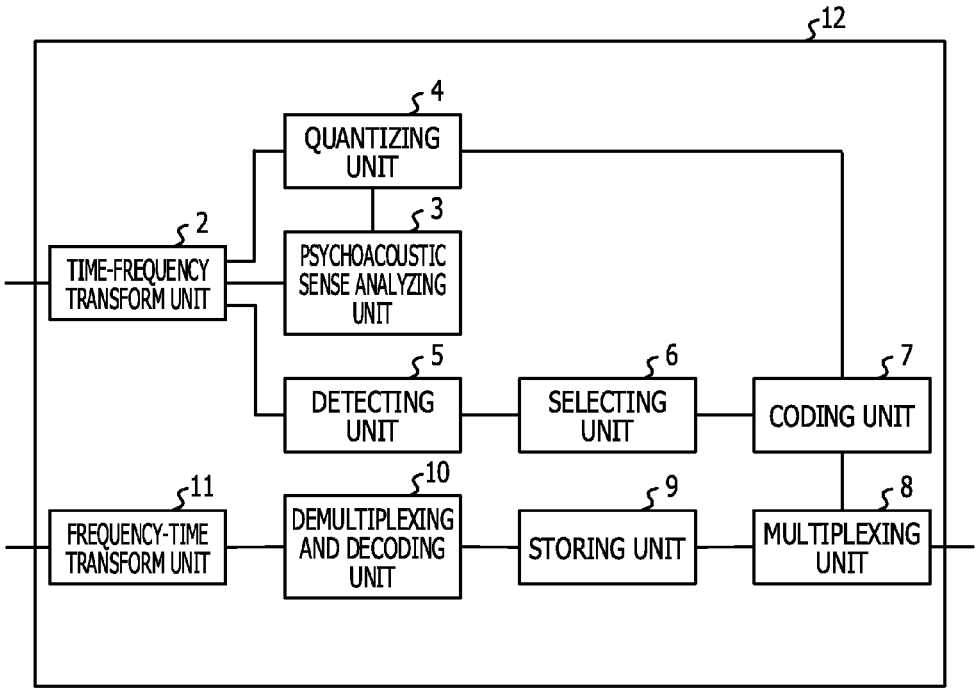
FIG. 10 is a diagram depicting functional blocks of an audio codec device according to one embodiment.

FIG. 10 is a diagram depicting functional blocks of an audio codec device according to one embodiment. As depicted in FIG. 10, an audio codec device 12 includes a time-frequency transform unit 2, a psychoacoustic sense analyzing unit 3, a quantizing unit 4, a detecting unit 5, a selecting unit 6, a coding unit 7, a multiplexing unit 8, a storing unit 9, a demultiplexing and decoding unit 10, and a frequency-time transform unit 11.

The above-described respective units possessed by the audio codec device 12 are formed as hardware circuits configured by hard-wired logic as separate circuits from each other for example. Alternatively, the above-described respective units possessed by the audio codec device 12 may be implemented in the audio codec device 12 as one integrated circuit obtained by integration of circuits corresponding to the respective units. The integrated circuit may be an integrated circuit such as an Application Specific Integrated Circuit (ASIC) or a Field Programmable Gate Array (FPGA) for example. Moreover, these respective units possessed by the audio codec device 12 may be functional modules implemented by a computer program executed on a processor possessed by the audio codec device 12. In FIG. 10, the time-frequency transform unit 2, the psychoacoustic sense analyzing unit 3, the quantizing unit 4, the detecting unit 5, the selecting unit 6, the coding unit 7, and the multiplexing unit 8 are similar to the functions disclosed in embodiment example 1 and therefore detailed description thereof is omitted.

The storing unit 9 is a semiconductor memory element such as a flash memory or a storage device such as a Hard Disk Drive (HDD) or an optical disc for example. The storing unit 9 is not limited to the above-described kinds of storage devices and may be a Random Access Memory (RAM) or a Read Only Memory (ROM). The storing unit 9 receives multiplexed coded audio signals from the multiplexing unit 8. The storing unit 9 outputs the multiplexed coded audio signals to the demultiplexing and decoding unit 10, with the output triggered by making of an instruction to the audio codec device 12 to reproduce the coded audio signals by a user for example.

The demultiplexing and decoding unit 10 is a hardware circuit configured by hard-wired logic for example. Furthermore, the demultiplexing and decoding unit 10 may be a functional module implemented by a computer program executed in the audio codec device 12. The demultiplexing and decoding unit 10 receives the multiplexed coded audio signals from the storing unit 9. The demultiplexing and decoding unit 10 demultiplexes the multiplexed coded audio signals and then decodes the coded audio signals. The demultiplexing and decoding unit 10 can use e.g. a method described in ISO/IEC 14496-3 as the demultiplexing method. Furthermore, the demultiplexing and decoding unit 10 can use e.g. a method described in ISO/IEC 13818-7 as the decoding method. The demultiplexing and decoding unit 10 outputs the decoded audio signals to the frequency-time transform unit 11.

The frequency-time transform unit 11 is a hardware circuit configured by hard-wired logic for example. Furthermore, the frequency-time transform unit 11 may be a functional module implemented by a computer program executed in the audio codec device 12. The frequency-time transform unit 11 receives the decoded audio signals from the demultiplexing and decoding unit 10. The frequency-time transform unit 11 transforms the audio signals from frequency signals to time signals by using an inverse fast Fourier transform corresponding to the above-described (Expression 1) and then outputs the time signals to an arbitrary external device (e.g. speaker).

In this manner, in the audio codec device disclosed in embodiment example 2, it is possible to store audio signals coded with high sound quality even under a coding condition with a low bit rate and then accurately decode the audio signals. It is also possible to apply such an audio codec device to a surveillance camera or the like that stores audio signals together with video signals for example. Furthermore, in embodiment example 2, an audio decoding device in which the demultiplexing and decoding unit 10 is combined with the frequency-time transform unit 11 may be configured for example.

Embodiment Example 3

Figure 11:
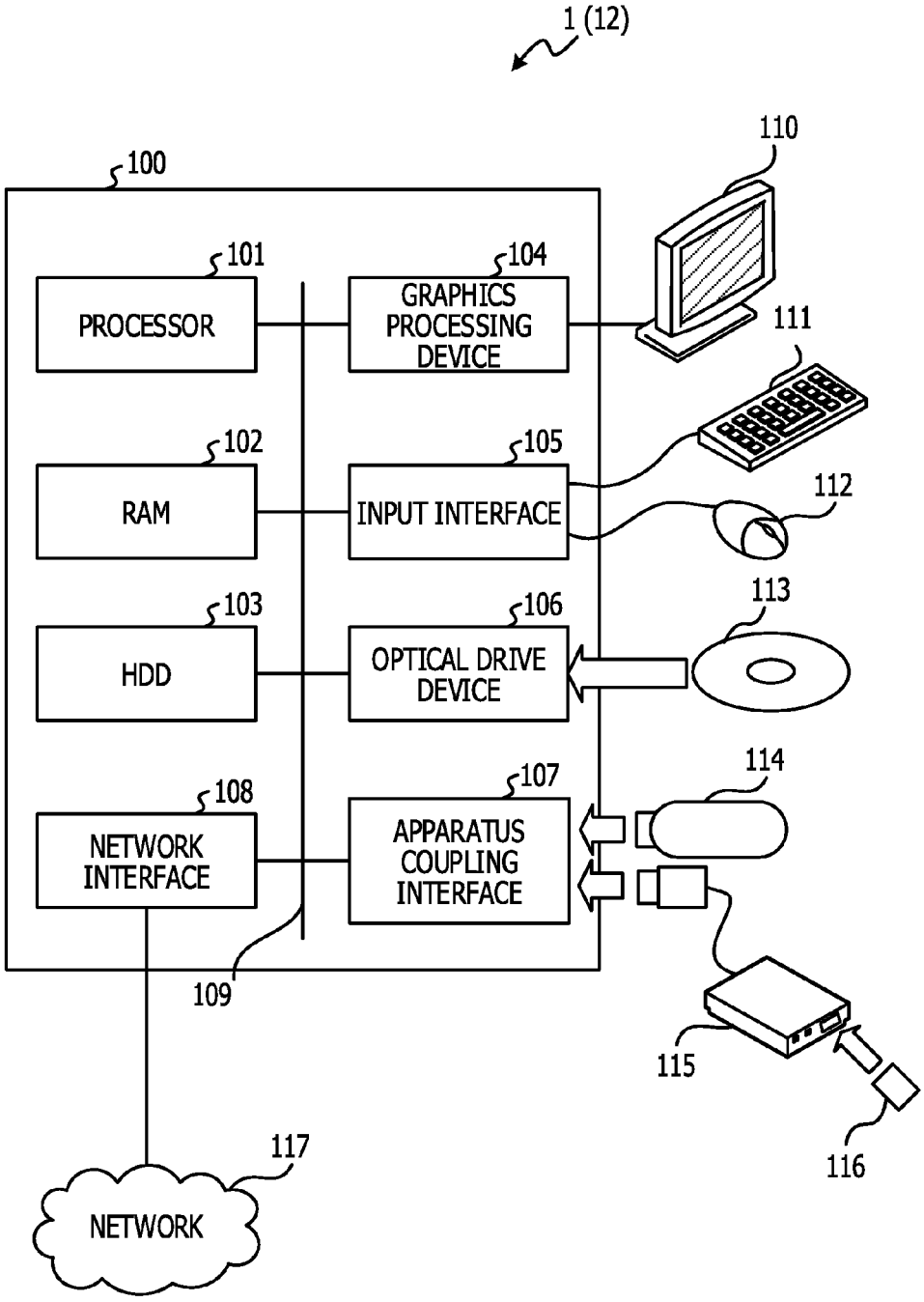
FIG. 11 is a hardware configuration diagram of a computer that functions as an audio coding device or an audio codec device according to one embodiment.

FIG. 11 is a hardware configuration diagram of a computer that functions as an audio coding device or an audio codec device according to one embodiment. The audio coding device depicted in FIG. 11 may be the audio coding device 1 depicted in FIG. 1, and the audio codec device depicted in FIG. 11 may be the audio codec device 12 depicted in FIG. 10. As depicted in FIG. 11, the audio coding device 1 or the audio codec device 12 is so configured as to include a computer 100 and input-output devices (peripheral apparatus) coupled to the computer 100.

In the computer 100, the whole device is controlled by a processor 101. To the processor 101, a Random Access Memory (RAM) 102 and plural pieces of peripheral apparatus are coupled via a bus 109. The processor 101 may be a multiprocessor. Furthermore, the processor 101 is a Central Processing Unit (CPU), a Micro Processing Unit (MPU), a Digital Signal Processor (DSP), an Application Specific Integrated Circuit (ASIC), or a Programmable Logic Device (PLD) for example. Moreover, the processor 101 may be a combination of two or more elements among CPU, MPU, DSP, ASIC, and PLD. For example, the processor 101 can execute the processing of the functional blocks described in FIG. 1 or 10, such as the time-frequency transform unit 2, the psychoacoustic sense analyzing unit 3, the quantizing unit 4, the detecting unit 5, the selecting unit 6, the coding unit 7, the multiplexing unit 8, the storing unit 9, the demultiplexing and decoding unit 10, and the frequency-time transform unit 11.

The RAM 102 is used as a main storage device of the computer 100. In the RAM 102, at least part of a program of an Operating System (OS) and application programs to be executed by the processor 101 is temporarily stored. Furthermore, various kinds of data for processing by the processor 101 are stored in the RAM 102. Among the pieces of peripheral apparatus coupled to the bus 109 are a Hard Disk Drive (HDD) 103, a graphics processing device 104, an input interface 105, an optical drive device 106, an apparatus coupling interface 107, and a network interface 108.

The HDD 103 magnetically performs writing and reading of data to and from a built-in disk. The HDD 103 is used as an auxiliary storage device of the computer 100 for example. In the HDD 103, a program of an OS, application programs, and various kinds of data are stored. It is also possible to use a semiconductor storage device such as a flash memory as the auxiliary storage device.

A monitor 110 is coupled to the graphics processing device 104. The graphics processing device 104 makes various kinds of images be displayed on the screen of the monitor 110 in accordance with a command from the processor 101. As the monitor 110, there are a display device using a Cathode Ray Tube (CRT), a liquid crystal display device, etc.

A keyboard 111 and a mouse 112 are coupled to the input interface 105. The input interface 105 transmits, to the processor 101, signals sent from the keyboard 111 and the mouse 112. The mouse 112 is one example of pointing devices and it is also possible to use another pointing device. As other pointing devices, there are a touch panel, a tablet, a touch pad, a trackball, etc.

The optical drive device 106 performs reading of data recorded in an optical disc 113 by using laser light or the like. The optical disc 113 is a portable recording medium in which data is so recorded as to be readable through reflection of light. Examples of the optical disc 113 include a Digital Versatile Disc (DVD), a DVD-RAM, a Compact Disc Read Only Memory (CD-ROM), a CD-R (Recordable)/RW (Re-Writable), and so forth. A program stored in the optical disc 113 as a portable recording medium is installed into the audio coding device 1 or the audio codec device 12 via the optical drive device 106. The installed given program is executable by the audio coding device 1 or the audio codec device 12.

The apparatus coupling interface 107 is a communication interface for coupling peripheral apparatus to the computer 100. For example, a memory device 114 and a memory reader-writer 115 can be coupled to the apparatus coupling interface 107. The memory device 114 is a recording medium equipped with a function of communications with the apparatus coupling interface 107. The memory reader-writer 115 is a device that performs writing of data to a memory card 116 or reading of data from the memory card 116. The memory card 116 is a card-type recording medium.

The network interface 108 is coupled to a network 117. The network interface 108 performs transmission and reception of data with another computer or communication apparatus via the network 117.

The computer 100 implements the above-described audio coding processing function and so forth by executing a program recorded in a computer-readable recording medium for example. A program in which the contents of the processing to be executed by the computer 100 are described can be recorded in various recording media. The above-described program can be configured from one or plural functional modules. For example, the program can be configured from functional modules to implement the processing of the time-frequency transform unit 2, the psychoacoustic sense analyzing unit 3, the quantizing unit 4, the detecting unit 5, the selecting unit 6, the coding unit 7, the multiplexing unit 8, the storing unit 9, the demultiplexing and decoding unit 10, the frequency-time transform unit 11, and so forth depicted in FIG. 1 or 10. The program to be executed by the computer 100 can be stored in the HDD 103. The processor 101 loads at least part of the program in the HDD 103 into the RAM 102 and executes the program. Furthermore, it is also possible that the program to be executed by the computer 100 is recorded in a portable recording medium such as the optical disc 113, the memory device 114, or the memory card 116. The program stored in the portable recording medium becomes executable after being installed into the HDD 103 under control from the processor 101 for example. Furthermore, it is also possible that the processor 101 directly reads out the program from the portable recording medium and executes the program.

The respective constituent elements of the respective devices depicted in the drawings do not necessarily need to be configured as depicted in the drawings physically. For example, specific forms of distribution and integration of the respective devices are not limited to those depicted in the drawings and all or part thereof can be so configured as to be distributed and integrated functionally or physically in arbitrary unit depending on various kinds of loads and use status and so forth. Furthermore, various kinds of processing explained in the above-described embodiment examples can be implemented by executing a program prepared in advance by a computer such as a personal computer or a work station.

Furthermore, in the above-described embodiment examples, the respective constituent elements of the respective devices depicted in the drawings do not necessarily need to be configured as depicted in the drawings physically. For example, specific forms of distribution and integration of the respective devices are not limited to those depicted in the drawings and all or part thereof can be so configured as to be distributed and integrated functionally or physically in arbitrary unit depending on various kinds of loads and use status and so forth.

Furthermore, the audio coding device in the above-described respective embodiments can be implemented in various kinds of apparatus used to transmit or record audio signals, such as a computer, a recorder of video signals, or a video transmitting device.

All examples and specific terms cited here are intended for the instructional purpose of helping those skilled in the art understand concepts to which the present inventors contribute for promotion of the present invention and the relevant techniques, and will be so interpreted as not to be limited to configurations in any example in the present specification, such specific cited examples and conditions relating to representing superiority and inferiority of the present invention. Although the embodiments of the present invention are described in detail, it shall be understood that various changes, substitutions, and alterations can be added thereto without departing from the scope of the present invention.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An audio coding device comprising:

a memory; and a processor configured to execute a plurality of instructions stored in the memory, the instructions comprising:

selecting a main lobe among a plurality of lobes detected from a frequency signal configuring an audio signal on a basis of bandwidth and power of the plurality of lobes; and coding the audio signal in such a manner that a first amount of bits per a unit frequency domain allocated to coding of a frequency signal of the main lobe selected is larger than a second amount of bits per a unit frequency domain allocated to coding of a frequency signal of a side lobe as a lobe other than the main lobe until an amount of bits relating to the coding is within a bit rate, wherein the selecting includes:

prescribing, as a threshold, a value of a first inflection point at which the power is lowest in an inflection point group in the plurality of lobes, prescribing, as a threshold, a value obtained by increasing in the power by a predetermined value from the threshold prescribed as the value of the first inflection point, and selecting, in the inflection point group, a third inflection point and a fourth inflection point as a start point and an end point of the main lobe, respectively, the third inflection point and the fourth inflection point being adjacent to a second inflection point at which the power is highest, on a lower frequency side and a higher frequency side, respectively, each of the third inflection point and the fourth inflection point having a value that is equal to or larger than the threshold prescribed as the value of the first inflection point and is smaller than the threshold prescribed as the value according to the increasing.

2. The device according to claim 1, wherein the selecting selects a widest lobe having bandwidth that is the widest among the plurality of lobes as a main lobe candidate, and selects the main lobe candidate as the main lobe when the bandwidth of the main lobe candidate is equal to or larger than a first threshold and power of the main lobe candidate is equal to or larger than a second threshold.

3. The device according to claim 1, wherein the coding codes the audio signal with dropping of the frequency signal of the side lobe in order for the first amount of bits and the second amount of bits for the coding of the audio signal to converge on the bit rate.

4. The device according to claim 3, wherein the coding codes the audio signal with the dropping of the frequency signal of the side lobe in increasing order of the power of the frequency signal until convergence on the bit rate.

5. The device according to claim 3, wherein the coding codes the audio signal with further dropping of the frequency signal of the main lobe in increasing order of a ratio of the power of the frequency signal to a masking threshold until convergence on the bit rate.

6. The device according to claim 1, wherein the selecting determines that a fricative is included in the audio signal when the selecting selects the main lobe.

7. An audio coding method comprising:

selecting a main lobe among a plurality of lobes detected from a frequency signal configuring an audio signal on a basis of bandwidth and power of the plurality of lobes; and coding, by a computer processor, the audio signal in such a manner that a first amount of bits per unit frequency domain allocated to coding of a frequency signal of the main lobe selected is larger than a second amount of bits per a unit frequency domain allocated to the coding of a frequency signal of a side lobe as a lobe other than the main lobe until an amount of bits relating to the coding is within a bit rate, wherein the selecting includes:

prescribing, as a threshold, a value of a first inflection point at which the power is lowest in an inflection point group in the plurality of lobes, prescribing, as a threshold, a value obtained by increasing in the power by a predetermined value from the threshold prescribed as the value of the first inflection point, and selecting, in the inflection point group, a third inflection point and a fourth inflection point as a start point and an end point of the main lobe, respectively, the third inflection point and the fourth inflection point being adjacent to a second inflection point at which the power is highest, on a lower frequency side and a higher frequency side, respectively, each of the third inflection point and the fourth inflection point having a value that is equal to or larger than the threshold prescribed as the value of the first inflection point and is smaller than the threshold prescribed as the value according to the increasing.

8. The method according to claim 7, wherein the selecting selects a widest lobe having bandwidth that is the widest among the plurality of lobes as a main lobe candidate, and selects the main lobe candidate as the main lobe when the bandwidth of the main lobe candidate is equal to or larger than a first threshold and power of the main lobe candidate is equal to or larger than a second threshold.

9. The method according to claim 7, wherein the coding codes the audio signal with dropping of the frequency signal of the side lobe in order for the first amount of bits and the second amount of bits for the coding of the audio signal to converge on the bit rate.

10. The method according to claim 9, wherein the coding codes the audio signal with the dropping of the frequency signal of the side lobe in increasing order of the power of the frequency signal until convergence on the bit rate.

11. The method according to claim 9, wherein the coding codes the audio signal with further dropping of the frequency signal of the main lobe in increasing order of a ratio of the power of the frequency signal to a masking threshold until convergence on the bit rate.

12. The method according to claim 7, wherein the selecting determines that a fricative is included in the audio signal when the selecting selects the main lobe.

13. An audio codec device comprising:

a memory; and a processor configured to execute a plurality of instructions stored in the memory, the instructions comprising:

selecting a main lobe among a plurality of lobes detected from a frequency signal configuring an audio signal on a basis of bandwidth and power of the plurality of lobes; and coding the audio signal in such a manner that a first amount of bits per unit frequency domain allocated to coding of a frequency signal of the main lobe is larger than a second amount of bits per the unit frequency domain allocated to the coding of a frequency signal of a side lobe as the lobe other than the main lobe until an amount of bits relating to the coding is within a bit rate; and decoding the audio signal that is coded, the selecting includes:

prescribing, as a threshold, a value of a first inflection point at which the power is lowest in an inflection point group in the plurality of lobes, prescribing, as a threshold, a value obtained by increasing in the power by a predetermined value from the threshold prescribed as the value of the first inflection point, and selecting, in the inflection point group, a third inflection point and a fourth inflection point as a start point and an end point of the main lobe, respectively, the third inflection point and the fourth inflection point being adjacent to a second inflection point at which the power is highest, on a lower frequency side and a higher frequency side, respectively, each of the third inflection point and the fourth inflection point having a value that is equal to or larger than the threshold prescribed as the value of the first inflection point and is smaller than the threshold prescribed as the value according to the increasing.

* * * * *